US009133724B2

(12) United States Patent
Winn et al.

(10) Patent No.: US 9,133,724 B2
(45) Date of Patent: Sep. 15, 2015

(54) TURBOMACHINE COMPONENT INCLUDING A COVER PLATE

(75) Inventors: Aaron Gregory Winn, Piedmont, SC (US); Niranjan Gokuldas Pai, Clifton Park, NY (US); Michael Gordon Sherman, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 821 days.

(21) Appl. No.: 13/345,959

(22) Filed: Jan. 9, 2012

(65) Prior Publication Data

US 2013/0177408 A1 Jul. 11, 2013

(51) Int. Cl.
*F01D 9/04* (2006.01)

(52) U.S. Cl.
CPC ..... *F01D 9/042* (2013.01); *F01D 9/041* (2013.01); *Y10T 29/49236* (2013.01)

(58) Field of Classification Search
CPC ..... F04D 29/64; F04D 29/644; F01D 25/24; F01D 25/243; F01D 25/28; F01D 11/005; F01D 11/08
USPC ..... 415/126, 127, 128, 134, 170.1, 173.1, 415/213.1, 214.1, 209.2, 201; 29/889.22
See application file for complete search history.

(56) References Cited

U.S. PATENT DOCUMENTS

| | | | |
|---|---|---|---|
| 4,187,054 A | 2/1980 | Landis, Jr. et al. | |
| 5,120,192 A | 6/1992 | Ohtomo et al. | |
| 5,197,852 A | 3/1993 | Walker et al. | |
| 5,320,483 A | 6/1994 | Cunha et al. | |
| 5,609,466 A | 3/1997 | North et al. | |
| 6,142,730 A | 11/2000 | Tomita et al. | |
| 6,217,279 B1 | 4/2001 | Ai et al. | |
| 6,227,798 B1 | 5/2001 | Demers et al. | |
| 6,382,906 B1 * | 5/2002 | Brassfield et al. | 415/115 |
| 6,383,602 B1 | 5/2002 | Fric et al. | |
| 6,386,825 B1 | 5/2002 | Burdgick | |
| 6,418,618 B1 | 7/2002 | Burdgick | |
| 6,530,744 B2 | 3/2003 | Liotta et al. | |
| 6,761,529 B2 | 7/2004 | Soechting et al. | |
| 6,769,865 B2 | 8/2004 | Kress et al. | |
| 6,843,479 B2 | 1/2005 | Burdgick | |

(Continued)

FOREIGN PATENT DOCUMENTS

| | | |
|---|---|---|
| EP | 1164252 A2 | 12/2001 |
| EP | 1262634 A2 | 12/2002 |

(Continued)

OTHER PUBLICATIONS

Search Report and Written Opinion from EP Application No. 13150157.9 dated Mar. 19, 2013.

*Primary Examiner* — Dwayne J White
*Assistant Examiner* — William Grigos

(57) ABSTRACT

A turbomachine component includes a body having a first end that extends to a second end. One of the first and second ends includes a mounting element, and a mounting component. A cover plate is arranged at the one of the first and second ends to establish an interface region. The cover plate includes a mounting member configured to align with the mounting element, and a mounting portion configured to align with the mounting element. A fastener member is configured and disposed to cooperate with the mounting element and the mounting member to constrain the cover plate to the body along at least two axes with the interface region being devoid of a metallurgical bond.

16 Claims, 3 Drawing Sheets

(56) References Cited

U.S. PATENT DOCUMENTS

| | | | | |
|---|---|---|---|---|
| 6,877,952 | B2 * | 4/2005 | Wilson | 415/136 |
| 6,884,026 | B2 * | 4/2005 | Glynn et al. | 415/173.1 |
| 6,932,568 | B2 | 8/2005 | Powis et al. | |
| 6,984,101 | B2 | 1/2006 | Schiavo, Jr. | |
| 7,008,185 | B2 | 3/2006 | Peterman et al. | |
| 7,029,228 | B2 | 4/2006 | Chan et al. | |
| 7,044,709 | B2 * | 5/2006 | Bruce et al. | 415/173.1 |
| 7,056,084 | B2 * | 6/2006 | Nagane et al. | 415/116 |
| 7,252,481 | B2 | 8/2007 | Stone | |
| 7,278,820 | B2 * | 10/2007 | Keller | 415/173.1 |
| 7,494,317 | B2 * | 2/2009 | Keller et al. | 415/136 |
| RE40,658 | E | 3/2009 | Powis et al. | |
| 7,534,086 | B2 * | 5/2009 | Mazzola et al. | 415/173.1 |
| 7,918,024 | B2 | 4/2011 | Mooney, Jr. et al. | |
| 2002/0028134 | A1 | 3/2002 | Burdgick | |
| 2002/0182057 | A1 | 12/2002 | Liotta et al. | |
| 2002/0187040 | A1 | 12/2002 | Predmore | |
| 2005/0244267 | A1 | 11/2005 | Coign et al. | |
| 2006/0053798 | A1 | 3/2006 | Hadder | |
| 2006/0062673 | A1 | 3/2006 | Coign et al. | |
| 2006/0073011 | A1 | 4/2006 | Lee et al. | |
| 2006/0171812 | A1 | 8/2006 | Albrecht et al. | |
| 2007/0009349 | A1 * | 1/2007 | Ward et al. | 415/115 |
| 2007/0237624 | A1 | 10/2007 | Nigmatulin | |
| 2008/0087021 | A1 * | 4/2008 | Radonovich et al. | 60/752 |
| 2008/0089780 | A1 | 4/2008 | Erickson et al. | |
| 2008/0152488 | A1 | 6/2008 | Kammel et al. | |
| 2010/0011773 | A1 | 1/2010 | Suleiman et al. | |
| 2010/0068041 | A1 | 3/2010 | Nigmatulin et al. | |
| 2010/0104426 | A1 * | 4/2010 | Keller et al. | 415/173.1 |
| 2010/0278631 | A1 | 11/2010 | Heda et al. | |
| 2010/0281879 | A1 | 11/2010 | Shapiro et al. | |
| 2010/0284800 | A1 | 11/2010 | Sewall et al. | |
| 2011/0014045 | A1 | 1/2011 | McCall | |
| 2011/0014054 | A1 | 1/2011 | Nagler et al. | |
| 2011/0044803 | A1 | 2/2011 | Di Paola et al. | |
| 2011/0229305 | A1 * | 9/2011 | Bergman et al. | 415/115 |
| 2013/0177384 | A1 | 7/2013 | Coign et al. | |

FOREIGN PATENT DOCUMENTS

| | | | |
|---|---|---|---|
| EP | 2366873 | A2 | 9/2011 |
| JP | 61066802 | A | 4/1986 |

* cited by examiner

TURBOMACHINE COMPONENT INCLUDING A COVER PLATE

BACKGROUND OF THE INVENTION

The subject matter disclosed herein relates to the art of turbomachines and, more particularly, to a cover plate for a turbomachine component.

Many turbomachines include a compressor portion linked to a turbine portion through a common compressor/turbine shaft or rotor and a combustor assembly. The compressor portion guides a compressed air flow through a number of sequential stages toward the combustor assembly. In the combustor assembly, the compressed air flow mixes with a fuel to form a combustible mixture. The combustible mixture is combusted in the combustor assembly to form hot gases. The hot gases are guided to the turbine portion through a transition piece. The hot gases expand through the turbine portion creating work that is output, for example, to power a generator, a pump, or to provide power to an aircraft. In addition to providing compressed air for combustion, a portion of the compressed airflow is passed through the turbine portion for cooling purposes.

The portion of the compressed airflow for cooling purposes often times flows through components that are exposed to the hot gases. Accordingly, many turbomachine components include internal passageways that provide conduits for the cooling airflow. Generally the components are formed with the internal passages from various super alloy materials and then provided with additional structure such as cover plates, baffles, or the like that either prevents or channels cooling airflow in a particular manner. The additional structure is typically welded to the component.

BRIEF DESCRIPTION OF THE INVENTION

According to one aspect of the exemplary embodiment, a turbomachine component includes a body having a first end that extends to a second end. One of the first and second ends includes a mounting element, and a mounting component. A cover plate is arranged at the one of the first and second ends to establish an interface region. The cover plate includes a mounting member configured to align with the mounting element, and a mounting portion configured to align with the mounting element. A fastener member is configured and disposed to cooperate with the mounting element and the mounting member to constrain the cover plate to the body along at least two axes with the interface region being devoid of a metallurgical bond.

According to another aspect of the exemplary embodiment, a method of joining a cover plate to a turbomachine component without welding includes positioning the cover plate on the turbomachine component, aligning an opening formed in a mounting element provided on the turbomachine component with an opening formed on a mounting member provided on the cover plate to establish a fastener passage, and inserting a fastener through the fastener passage to constrain the cover plate to the turbomachine component along at least two axes.

According to yet another aspect of the exemplary embodiment, a turbomachine system includes a compressor portion, a turbine portion mechanically linked to the compressor portion, a combustor assembly fluidly connected to the compressor portion and the turbine portion, and a turbomachine component operatively associated with one of the compressor portion, the turbine portion and the combustor assembly. The turbomachine component includes a body having a first end that extends to a second end. One of the first and second ends includes a mounting element, and a mounting component. A cover plate is arranged at the one of the first and second end to establish an interface region. The cover plate includes a mounting member configured to align with the mounting element, and a mounting portion configured to align with the mounting element. A fastener member is configured and disposed to cooperate with the mounting element and the mounting member to constrain the cover plate to the body along at least two axes with the interface region being devoid of a metallurgical bond.

These and other advantages and features will become more apparent from the following description taken in conjunction with the drawings.

BRIEF DESCRIPTION OF DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
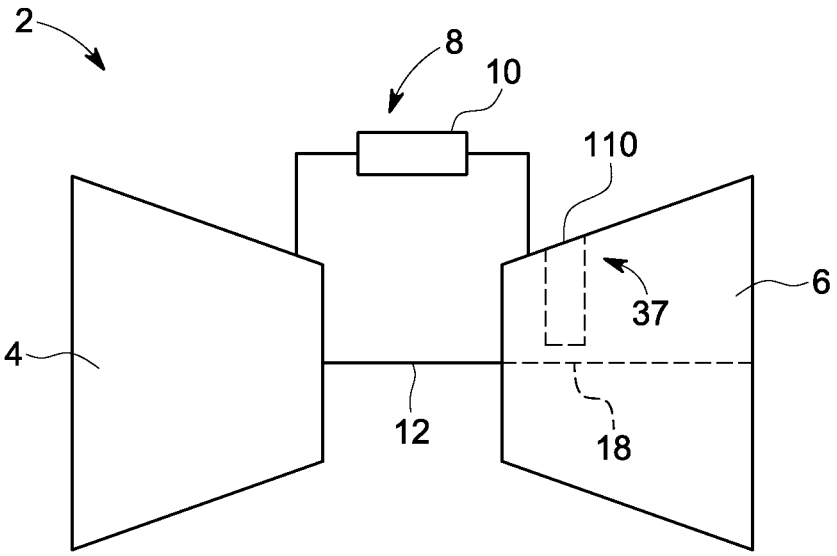
FIG. 1 is a schematic view of a turbomachine including a turbomachine component having a cover plate in accordance with an exemplary embodiment.
Figure 2:
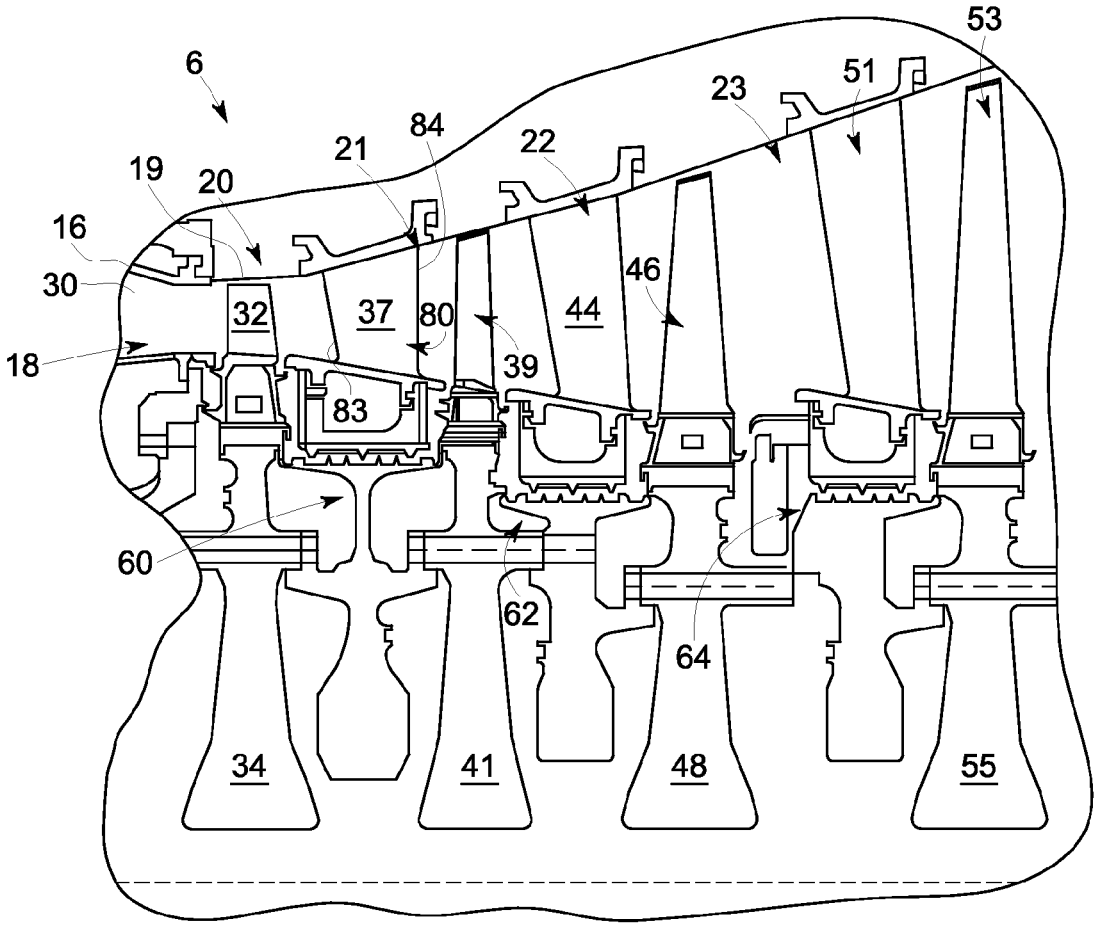
FIG. 2 is a partial cross-sectional view of a turbine portion of the turbomachine of FIG. 1.

With reference to FIGS. 1 and 2, a turbomachine constructed in accordance with an exemplary embodiment is indicated generally at 2. Turbomachine 2 includes a compressor portion 4 operatively connected to a turbine portion 6. A combustor assembly 8 is fluidly connected to compressor portion 4 and turbine portion 6. Combustor assembly 8 is formed from a plurality of circumferentially spaced combustors, one of which is indicated at 10. Of course it should be understood that combustor assembly 8 could include other arrangements of combustors. Compressor portion 4 is also linked to turbine portion 6 through a common compressor/turbine shaft 12. Combustor assembly 8 delivers products of combustion through a transition piece 16 to a gas path 18 in turbine portion 6. The products of combustion expand through turbine portion 6 to power, for example, a generator, a pump, an aircraft or the like.

Figure 3:
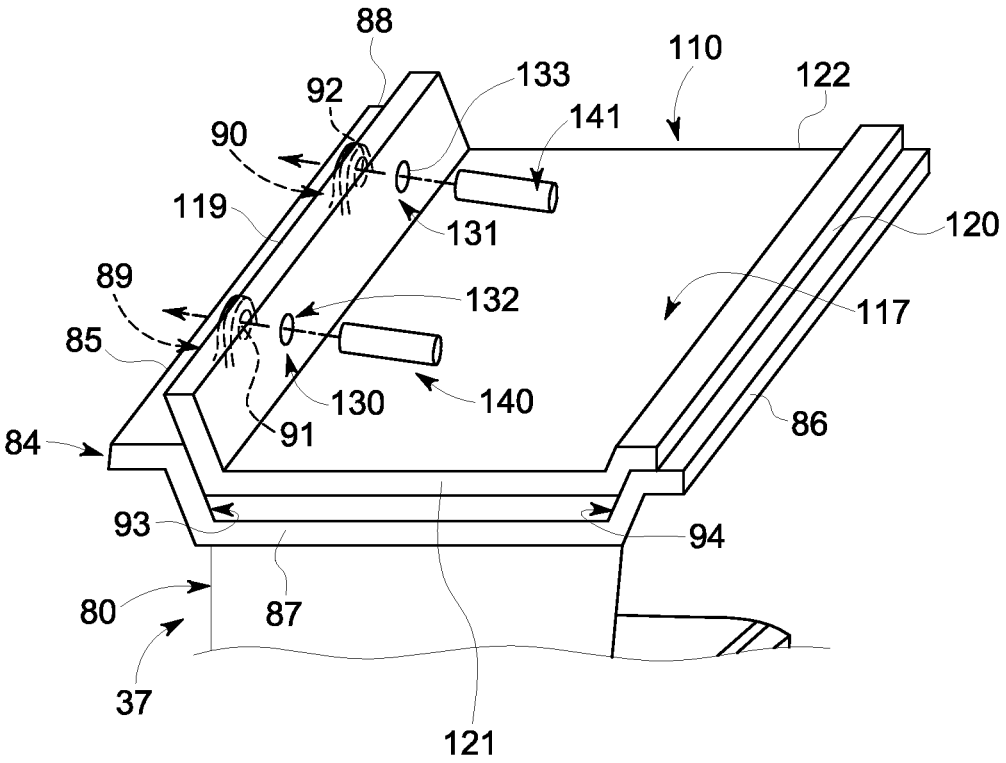
FIG. 3 is a partial perspective view of a turbomachine component having a cover plate in accordance with an exemplary embodiment.
Figure 4:
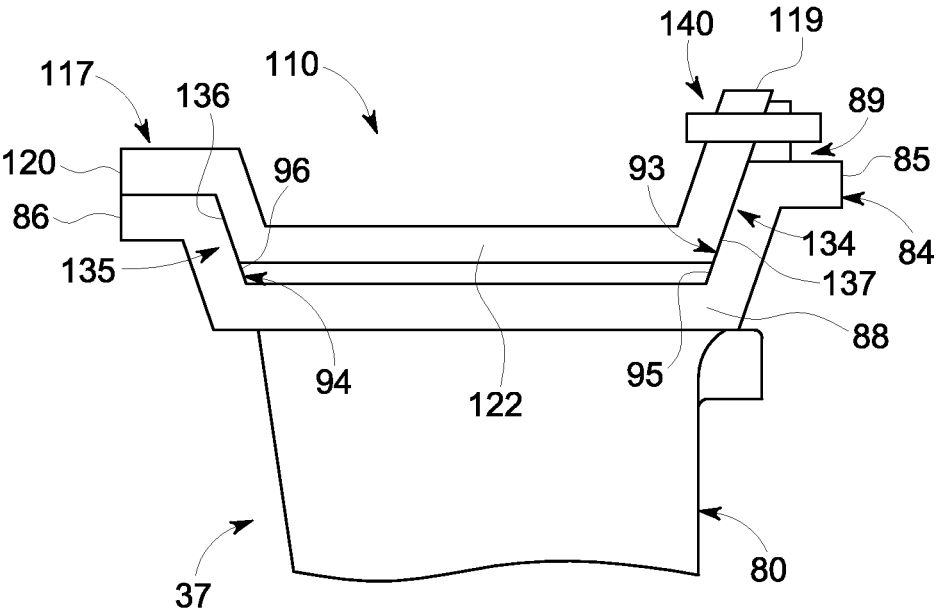
FIG. 4 is a partial plan view of the turbomachine component and cover plate of FIG. 3.

In the exemplary embodiment shown, turbine portion 6 includes a turbine housing 19 within which are disposed first, second, third, and fourth stages 20-23 that extend along gas path 18. Of course it should be understood that the number of stages in turbine portion 6 could vary. First stage 20 includes a plurality of first stage stators or nozzles, one of which is indicated at 30 arranged in an annular array, and a plurality of first stage buckets or blades, one of which is indicated at 32, mounted to a first stage rotor wheel 34. Second stage 21 includes a plurality of second stage stators or nozzles, one of which is indicated at 37 arranged in an annular array, and a plurality of second stage buckets or blades, one of which is indicated at 39, mounted to a second stage rotor wheel 41. Third stage 22 includes a plurality of third stage stators or nozzles, one of which is indicated at 44 arranged in an annular array, and a plurality of third stage buckets or blades, one of which is indicated at 46, mounted to a third stage rotor wheel 48. Fourth stage 23 includes a plurality of fourth stage stators or nozzles, one of which is indicated at 51 arranged in an annular array, and a plurality of fourth stage buckets or blades, one of which is indicated at 53, mounted to a fourth stage rotor wheel 55. Turbomachine 2 is also shown to include a plurality of inter-stage seal members 60, 62, and 64 arranged between adjacent ones of first, second, third, and fourth stages 20-23. As best shown in FIGS. 3 and 4, stator 37 includes a body 80 having a first end 83 (FIG. 2) that extends to a second end 84. Second end 84 includes a first side 85 and an opposing second side 86 that are joined by first and second opposing edges 87 and 88. Second end 84 is also shown to include first and second mounting elements 89 and 90 arranged at first side 85. Each mounting element 89, 90 includes corresponding first and second openings 91 and 92. Second end 84 is further shown to include first and second mounting components 93 and 94. Mounting components 93 and 94 constitute first and second angled surface sections 95 and 96.

In accordance with an exemplary embodiment, stator 37 includes a cover plate 110 that is secured to second end 84 defining an interface region (not separately labeled). Cover plate 110 may serve as an interface to turbine housing 19, or cover cooling passages (not shown) formed in stator 37. Cover plate 110 includes a body 117 having first and second opposing end sections 119 and 120 that are joined by first and second opposing edge sections 121 and 122. Cover plate 110 includes first and second mounting members 130 and 131 that take the form of first and second openings 132 and 133 formed in first edge section 119. In addition to mounting members 130 and 131, cover plate 110 includes first and second mounting portions 134 and 135. Mounting portions 134 and 135 constitute first and second angled surface portions 136 and 137 provided at first and second end sections 119 and 120 respectively. Angled surface portions 136 and 137 are configured to nest with angled surface sections 95 and 96 as will be discussed more fully below.

In further accordance with the exemplary embodiment, cover plate 110 is constrained to second end 84 of stator 37 along three axes. More specifically, cover plate 110 is positioned upon second end 84 such that mounting portions 134 and 135 nest with mounting components 93 and 94 and mounting members 130 and 131 register with mounting elements 89 and 90. Mounting members 130 and 131 are considered to register with mounting elements 89 and 90 when first and second openings 132 and 133 formed in first edge section 119 align with first and second openings 91 and 92 of mounting elements 89 and 90 to form corresponding first and second fastener passages (not separately labeled).

At this point, first and second fasteners 140 and 141 are inserted into the first and second fastener passages. One of fasteners 140 and 141 is formed to pass into one of the first and second fastener passages with a first tolerance and the other of fasteners 140 and 141 are formed to pass into the other of the first and second fastener passages with a second tolerance that is distinct from the first tolerance. For example, first fastener 140 may have a slightly looser fit in the first fastener passage then does second fastener 141 in the second fastener passage. The difference in tolerances allow for different rates of thermal expansion of nozzle 37 and cover plate 110 as well as manufacturing tolerances that may lead to minor misalignments in forming the first and second fastener passages.

At this point it should be understood that the cover plate in accordance with the exemplary embodiment is constrained to the second end of the stator along three distinct axes. That is, the fasteners constrain the cover plate to the stator along two axes and the mating angled surfaces provide retention along a third axes. Thus, the present invention describes a system of joining turbomachine components without the need for welding. Joining without welding allows for improved assembly and disassembly operations thereby easing manufacturing and service. The lack of welding also reduces costs and complications associated with welding dissimilar metals, super alloys and the like. It should be further understood that while shown mounted to a stator, the cover plate and method of attachment can be employed in connection with various other turbomachine components arranged along the gas path or in a wheel space of the turbomachine.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A turbomachine nozzle comprising:

a nozzle body having a first end that extends to a second end, one of the first and second ends including a mounting element, and a mounting component, the mounting component defining an angled surface having a first angle, the first angle being at least one of an angle that is greater than 0° and less than 90° and an angle that is greater than 90° and less than 180°;

a cover plate arranged at the one of the first and second ends to establish an interface region, the cover plate including a mounting member configured to align with the mounting element, and a mounting portion configured to align with the mounting component, the mounting portion defining an angled surface portion having a second angle that substantially corresponds to the first angle; and a fastener member configured and disposed to cooperate with the mounting element and the mounting member to constrain the cover plate to the nozzle body along at least two axes with the interface region being devoid of a metallurgical bond.

2. The turbomachine component according to claim 1, wherein the mounting component interacts with the mounting portion to constrain the cover plate to the nozzle body along a third axis.

3. The turbomachine component according to claim 1, wherein the mounting element includes a first opening and the mounting member includes a second opening, the second opening being configured and disposed to align with the first opening.

4. The turbomachine component according to claim 1, wherein the mounting element includes a first mounting element and a second mounting element, and the mounting member includes a first mounting member and a second mounting member, the first and second mounting members being configured and disposed to align with corresponding ones of the first and second mounting elements.

5. The turbomachine component according to claim 4, wherein each of the first and second mounting elements includes corresponding first and second openings, and each of the first and second mounting members includes corresponding third and fourth openings, the third and fourth openings being configured and disposed to align with the first and second openings to form corresponding first and second fastener passages.

6. The turbomachine component according to claim 5, wherein the fastener member includes a first fastener configured and disposed to extend through the first fastener passage with a first tolerance and a second fastener configured and disposed to extend through the second fastener passage with a second tolerance.

7. The turbomachine component according to claim 6, wherein the first tolerance is distinct from the second tolerance.

8. The turbomachine component according to claim 1, wherein the mounting component comprises a surface section of the body and the mounting portion comprises a surface portion of the cover plate.

9. A method of joining a cover plate to a turbomachine nozzle without welding, the method comprising:

positioning the cover plate on the turbomachine nozzle;

aligning an opening formed in a mounting element provided on the turbomachine nozzle with an opening formed on a mounting member provided on the cover plate to establish a fastener passage;

nesting a mounting component having an angled surface defined by a first angle on the turbomachine nozzle, the first angle being at least one of an angle that is greater than 0° and less than 90° and an angle that is greater than 90° and less than 180° , with a mounting portion having an angled surface portion defined by a second angle that substantially corresponds with the first angle on the cover plate to constrain the cover plate to the turbomachine nozzle along a third axis; and inserting a fastener through the fastener passage to constrain the cover plate to the turbomachine nozzle along at least two axes.

10. The method of claim 9, wherein aligning the opening formed in a mounting element with the opening formed on a mounting member comprises aligning a first opening formed on a first mounting element with a first opening formed on a first mounting member to establish a first fastener passage and aligning a second opening formed on a second mounting element with a second opening formed on a second mounting member to establish a second fastener passage.

11. The method of claim 10, wherein inserting the fastener through the fastener passage includes inserting a first fastener through the first fastener passage and a second fastener through the second fastener passage.

12. The method of claim 11, further comprising inserting the first fastener through the first fastener passage with a first force and the second fastener through the second fastener passage with a second force that is distinct from the first force.

13. A turbomachine system comprising:

a compressor portion;

a turbine portion mechanically linked to the compressor portion;

a combustor assembly fluidly connected to the compressor portion and the turbine portion; and a turbomachine nozzle operatively associated with one of the compressor portion, the turbine portion and the combustor assembly, the turbomachine component comprising:

a nozzle body having a first end that extends to a second end, one of the first and second ends including a mounting element, and a mounting component, the mounting component defining an angled surface having a first angle, the first angle being at least one of an angle that is greater than 0° and less than 90° and an angle that is greater than 90° and less than 180°;

a cover plate arranged at the one of the first and second ends to establish an interface region, the cover plate including a mounting member configured to align with the mounting element, and a mounting portion configured to align with the mounting component, the mounting portion defining an angled surface portion having a second angle that substantially corresponds to the first angle; and a fastener member configured and disposed to cooperate with the mounting element and the mounting member to constrain the cover plate to the nozzle body along at least two axes with the interface region being devoid of a metallurgical bond.

14. The turbomachine according to claim 13, wherein the mounting component interacts with the mounting portion to constrain the cover plate to the nozzle body along a third axis.

15. The turbomachine according to claim 13, wherein the mounting element includes a first mounting element and a second mounting element, and the mounting member includes a first mounting member and a second mounting member that are configured and disposed to align with corresponding ones of the first and second mounting elements.

16. The turbomachine component according to claim 15, wherein each of the first and second mounting elements includes corresponding first and second openings, and each of the first and second mounting members includes corresponding third and fourth openings that are configured and disposed to align with the first and second opening to form first and second fastener passages configured and disposed to receive first and second fasteners respectively.

* * * * *